US005897483A

United States Patent [19]

Koch et al.

[11] Patent Number: 5,897,483

[45] **Date of Patent: * Apr. 27, 1999**

[54] LABORATORY CENTRIFUGE HAVING A CASING COVER AND ROTOR CHAMBER ADAPTED TO EXHAUST CIRCULATED AIR

[75] Inventors: Michael Koch, Osterode; Detlev Demmig, Seesen; Rüdiger Uhlendorf, Löwenhagen; Sebastian Reich, Hattorf, all of Germany

[73] Assignee: Kendro Laboratory Products, GmbH, Hanau, Germany

[ * ] Notice: This patent is subject to a terminal disclaimer.

[21] Appl. No.: 09/099,746

[22] Filed: Jun. 18, 1998

Related U.S. Application Data

[63] Continuation of application No. 08/843,749, Apr. 21, 1997, Pat. No. 5,772,572.

[30] Foreign Application Priority Data

Apr. 22, 1996 [DE] Germany ..... 196 15 702

[51] Int. Cl.[6] ..... B04B 15/02; B04B 5/02; B04B 7/02

[52] U.S. Cl. ..... 494/14; 494/16; 494/60

[58] Field of Search ..... 494/13, 14, 16, 494/20, 26, 60; 210/175, 180

[56] References Cited

U.S. PATENT DOCUMENTS

| | | | |
|---|---|---|---|
| 2,699,289 | 1/1955 | Allen et al. | 494/16 |
| 2,778,566 | 1/1957 | Garrett | 494/13 |
| 2,917,229 | 12/1959 | Benedetto et al. | 494/14 |
| 3,148,146 | 9/1964 | Asnes et al. | 494/16 X |
| 3,339,836 | 9/1967 | Mitchell et al. | 494/16 |
| 3,804,324 | 4/1974 | Sinn et al. | 494/14 |
| 3,860,166 | 1/1975 | Anderson | 494/13 |
| 4,053,104 | 10/1977 | Penhasi et al. | 494/14 |
| 4,193,536 | 3/1980 | Kubota | 494/14 |
| 4,221,325 | 9/1980 | Kubota | 494/14 |
| 5,490,830 | 2/1996 | Lovelady et al. | 494/60 |

FOREIGN PATENT DOCUMENTS

| | | | |
|---|---|---|---|
| 455876 | 11/1991 | European Pat. Off. . | |
| 265754 | 3/1989 | German Dem. Rep. . | |
| 1034550 | 7/1958 | Germany | 494/14 |
| 2240336 | 4/1974 | Germany . | |
| 2635261 | 3/1977 | Germany . | |
| 2611679 | 9/1977 | Germany . | |
| 3913792 | 11/1989 | Germany . | |
| 54-117975 | 9/1979 | Japan | 494/14 |
| 751078 | 6/1956 | United Kingdom . | |
| 95/27567 | 10/1995 | WIPO . | |

*Primary Examiner*—Charles E. Cooley
*Attorney, Agent, or Firm*—Workman, Nydegger & Seeley

[57] ABSTRACT

A laboratory centrifuge has a housing which can be closed by a casing cover and having in the housing a rotor chamber which contains a motor-driven vertical-axis rotor to accept test tubes. During operation, the test tubes are warmed by friction. To cool the centrifuge, cooling air is pulled in through openings in the lower side of the housing and upward into the rotor chamber by the fan action created by the rotation of the rotor. The air is guided out of the rotor chamber through an air exit in a direction of flow tangential to the perimeter of the rotor in a manner that ensures low turbulence and, thus, low noise. In particular, a slit-like air exit opening is arranged between the casing cover and the top side of the housing. In the annular gap between the rotor and the rotor chamber, an aerodynamically shaped displacement body is provided in a position at the side of the area of the air exit opening such that it directly follows the area of the air exit opening when viewed in the direction of rotation of the rotor. The displacement body is put on a molded part for attaching to the inside surface of the casing cover of the centrifuge such that the displacement body projects from the inside surface of the casing cover into the annular gap to thereby permit the cooling air to be guided out of the centrifuge with low turbulence and low noise.

16 Claims, 3 Drawing Sheets

LABORATORY CENTRIFUGE HAVING A CASING COVER AND ROTOR CHAMBER ADAPTED TO EXHAUST CIRCULATED AIR

This application is a continuation of U.S. patent application Ser. No. 08/843,749, filed Apr. 21, 1997 U.S. Pat. No. 5,772,572 and claims foreign priority benefits under Section 119 of Title 35 of the United States Code of German Utility Model Application No. 196 15 702.1, filed Apr. 22, 1996, which are incorporated herein by specific reference.

BACKGROUND OF THE INVENTION

1. The Field of the Invention

This invention concerns a laboratory centrifuge having a rotor chamber which can be closed by a casing cover and a housing which contains a motor-driven vertical-axis rotor to accept test tubes and which, during operation, has cooling air flowing through the housing upward into the rotor chamber.

2. The Relevant Technology

Laboratory centrifuges are well known. An exemplary laboratory centrifuge is provided, for example, in EP 0 455 876 A2. The laboratory centrifuge disclosed is arranged in a housing and has a motor driving a vertically oriented drive shaft. The test tubes, which are warmed by friction during operation of the centrifuge, are cooled by forced-air cooling which sucks in air in the direction of the axis of the shaft. In order to create a simple and economical air-cooled centrifuge in which it is certain that the cooling air neither carries suspended matter into the samples nor carries suspended matter out of the rotor housing, even if a test tube should break, the rotor is surrounded by an air-tight container. A fan wheel is set on the driven end of the shaft and air is sucked through openings in the floor surface of the housing below the fan wheel into the housing to be guided along upward to the walls of the air-tight container and to be axially distributed through operation of the fan wheel.

A centrifuge is also known from German patent DE 39 13 792 A1 in which noise from empty test tube holders is suppressed. The centrifuge is a conventional centrifuge having a rotor with a plurality of holders to accept test tubes set in the rotor in a circular configuration. The whistling noise produced by empty holders is suppressed by a flexible flap which has a fixed or stationary end attached to the rotor by an adapter and a free end lying opposite. In the non-rotating or non-operative state of the rotor, the free end extends radially inward in the direction toward the center of the rotor. In the rotating state of the rotor, the free end becomes folded over or backwards by the centrifugal force in such a way that it covers the opening of the empty test tube holder(s). Thus, the covering of the opening(s) by the flexible flap prevents the occurrence of the undesired high-pitched shrill whistling noise which would otherwise be produced by the holder if it is rotating without a test tube set in it.

A laboratory centrifuge is also known from DD 265 754 A3 which provides for air guided in a casing cover to cool the rotor. The centrifuge rotor sweeps away the air located in the rotor chamber and throws it outward. The air put under pressure in this manner is pressed through an opening located in the annular gap between the rotor and the rotor chamber and, thus, into an exit channel to be guided out to the surrounding atmosphere. The negative pressure formed in the rotor chamber is equalized by supplying air through an air entry channel also arranged in the area of the casing cover. This design requires a specially manufactured casing cover and, thus, increases the cost of the centrifuge.

A problem with air cooling of centrifuges is that, particularly in the area above the rotor, the air is very turbulent and produces significant noise. It would be an advance to provide a laboratory centrifuge that permitted air to flow around the rotor at flow rates which produce sufficient cooling yet demonstrated low turbulence and low noise.

OBJECTS AND BRIEF SUMMARY OF THE INVENTION

It is an object of the present invention to provide a laboratory centrifuge that suppresses noise caused by the exit of air from the rotor chamber in a simple and economical manner while permitting an optimal air flow rate to ensure cooling.

It is a further object of the present invention to provide such a laboratory centrifuge that can be achieved in a retrofit manner with existing centrifuges.

These and other objects and features of the present invention will become more fully apparent from the following description and appended claims, or may be learned by the practice of the invention as set forth hereinafter.

The present invention concerns a laboratory centrifuge having a rotor chamber which can be closed by a casing cover and a housing which contains a motor-driven vertical-axis rotor to accept test tubes and which, during operation, has cooling air flowing through the housing upward into the rotor chamber. Turbulence and noise from the exiting air are minimized by providing a slit-like exit opening between the casing cover and the top edge of the rotor chamber. In the annular gap between the rotor and the top of the rotor chamber, an aerodynamically shaped displacement body is provided in a position at the side of the area of the air exit opening such that it directly follows the area of the air exit opening when viewed in the direction of rotation of the rotor. The displacement body is formed on a molded article attached to the inside surface of the casing cover of the centrifuge. In this manner, the cooling air is guided out of the top of the rotor chamber through the air exit opening in a direction of flow tangential to the perimeter of the rotor in a manner that ensures low turbulence and, thus, low noise.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

This invention concerns a laboratory centrifuge having a rotor chamber which can be closed by a casing cover and a housing which contains a motor-driven vertical-axis rotor to accept test tubes. During operation, the centrifuge is cooled by cooling air pulled in through air entry openings in the lower side of the housing and upward into the rotor chamber by the fan action created by the rotation of the rotor. The air is guided out of the rotor chamber through an air exit opening in a direction of flow tangential to the perimeter of the rotor in a manner that ensures low turbulence and, thus, low noise.

In particular, a slit-like air exit opening is arranged between the casing cover and a top edge of the rotor chamber. Furthermore, in an annular gap between the rotor and the top of the rotor chamber wall, an aerodynamically shaped displacement body is provided in a position at the side of the area of the air exit opening such that it directly follows the area of the air exit opening when viewed in the direction of rotation of the rotor. The displacement body is formed on a molded article attached to the inside surface of the casing cover such that the displacement body projects from the inside surface of the casing cover into the annular gap, thereby permitting the cooling air to be guided out of the centrifuge with low turbulence and low noise.

In a preferred embodiment of the present invention, the displacement body is made as an integrated molded article made of an elastic material, preferably rubber, together with the peripheral seal for the casing cover and having the slit-like exit opening having a flow cutoff edge partially bounding the air exit area. The displacement body is positioned at the side of the air opening area in such a way that it directly follows the air exit opening when viewed in the direction of rotation of the rotor. The air exit opening is preferably positioned in the area of the casing cover between the hinges for connecting the casing cover to the housing.

Because significant air turbulence occurs in the area above the rotor, the noise produced can be practically completely eliminated by the present invention with this relatively simple implementation in the area of the casing cover to provide the air exit opening. In addition, the integral construction of the molded article has proven especially advantageous for use to retrofit existing centrifuges because the molded article may be inserted into casing covers of existing centrifuges.

Figure 1:
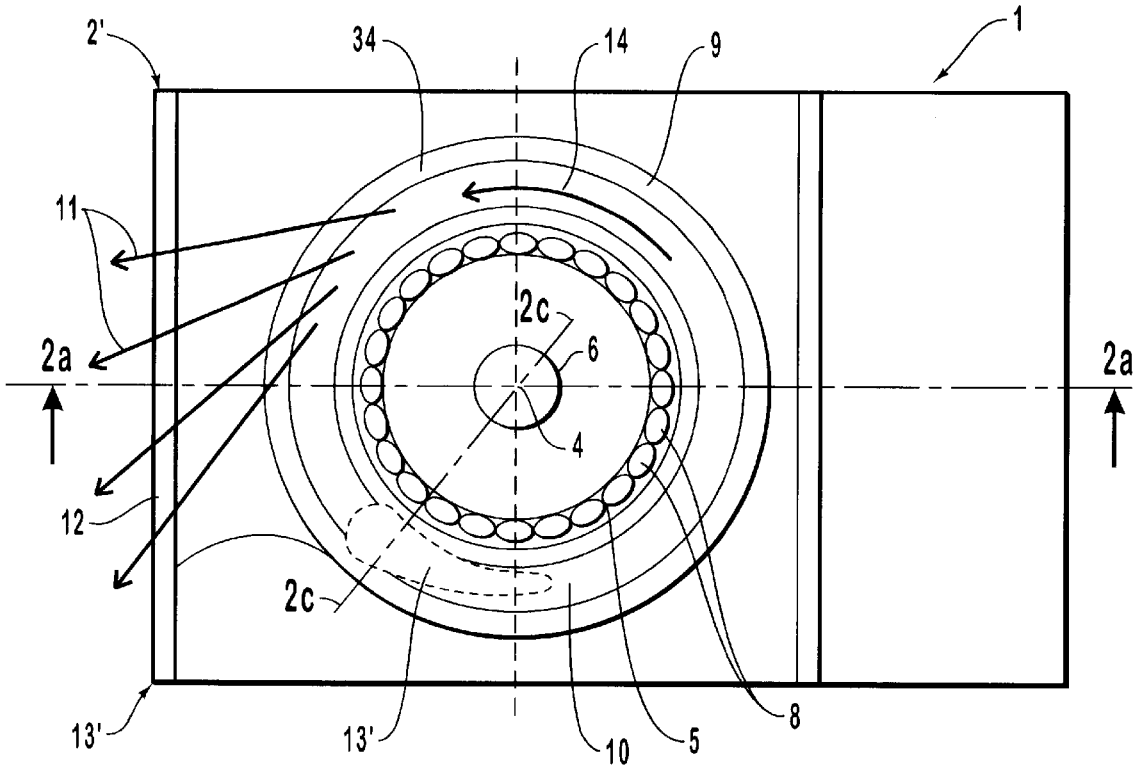
FIG. 1 shows a top view of the top part of a centrifuge in accord with the present invention with, however, the casing cover and the rotor covering removed and the position of the displacement body shown by the dashed line.

As seen in FIG. 1, the casing cover (which is not shown in order to provide a better view of the inside of the centrifuge) is connected with housing 1 at positions referenced with the numerals 2' and 3' with hinges (not shown). When viewed from above (and without the rotor covering which is necessary for operation of the centrifuge), rotor 5, which is axially symmetric to rotor axis 4 and rotor hub 6, contains test tubes 8 positioned in holes formed around the perimeter of the rotor 5. Annular gap 10 is between rotor 5 and the surrounding rotor chamber wall 9. Rotor chamber wall 9 bounds a rotor chamber 33 in which rotor 5 is disposed. Rotor hub 6 is connected on its lower side with the driving motor (not visible in this view) through a coupling in a mechanically solid but removable manner such that rotor 5 may be removed from the centrifuge housing 1. Rotor 5 is accessed from the exterior through an access opening 34 in housing 1.

In accordance with the invention, the flow of air away from rotor 5 in a tangential direction during operation of the centrifuge, symbolically represented with arrows 11, exits through the slit-like air exit opening 12 formed between the casing cover (not shown) and the top edge of the rotor chamber wall 9. The air exit opening 12 has an arc of approximately 60° when viewed from rotor axis 4. At the side of the air exit opening 12, at the symbolically represented position 13', a displacement body is positioned such that, when viewed in the direction of rotation of rotor 5 as indicated by arrow 14, the displacement body directly follows the air exit area of air exit opening 12. The displacement body in position 13' as indicated by the dash lines projects into the annular gap 10 between rotor 5 and the top of rotor chamber wall 9. The displacement body prevents the air from rotor 5, being guided toward the air exit opening 12, from becoming entrained again which could cause turbulent flow due to negative pressure and, thus, cause the occurrence of disturbing noise.

Figure 2A:
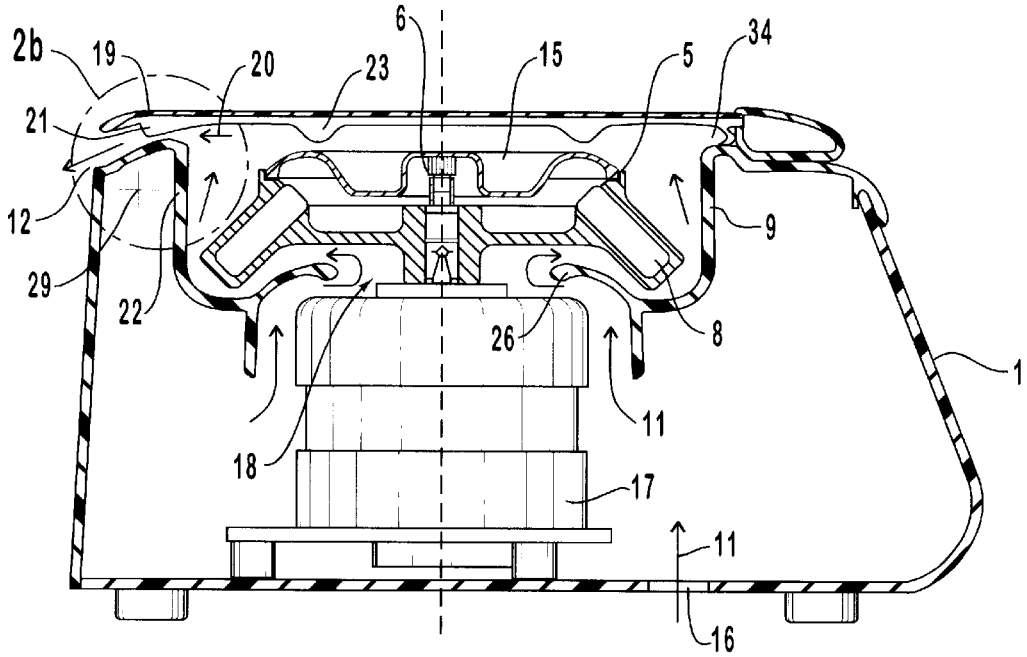
FIG. 2*a* shows a longitudinal section along the line 2*a*—2*a* through the rotor axis of FIG. 1 except that the rotor covering is shown in position over the rotor and the casing cover is shown closed upon the housing.

FIG. 2*a* shows a longitudinal section through the housing 1 and the rotor 5 along the line 2*a*—2*a* of FIG. 1 except that the rotor 5 covering 15 is shown in position over the rotors and the casing cover 19 is shown in the closed position. A complete side view of a drive motor 17 is also included in FIG. 2*a*. As shown, the heat arising from friction between the surface of the rotor 5 and the surrounding air of the rotor chamber 33 during operation of the centrifuge can be cooled by an air flow, symbolically represented by arrows 11, entering through an air entry opening 16 formed in the underside of the housing 1.

The entering air flow 11 is preferably guided through the lower annular gap-like opening 18 between rotor 5 and rotor chamber wall 9 parallel to the rotor axis 4 in the jacket area of the drive motor 17 and upward to flow around rotor 5. The centrifugal force produced by rotor 5, according to the radial ventilator principle, pushes the air surrounding the rotor 5 outward into the peripheral area of the rotors. There, overpressure guides the air away through the wedge-shaped opening area 20 of exit opening 12, between the top edge 22 of the rotor chamber 9 and the casing cover 19, and out to the surrounding atmosphere through air exit opening 12. In this manner, a fan function is achieved by the rotation of the rotor 5. The air exiting through air exit opening 12 is preferably directed downward by flow cutoff lower edge 21.

Figure 2B:
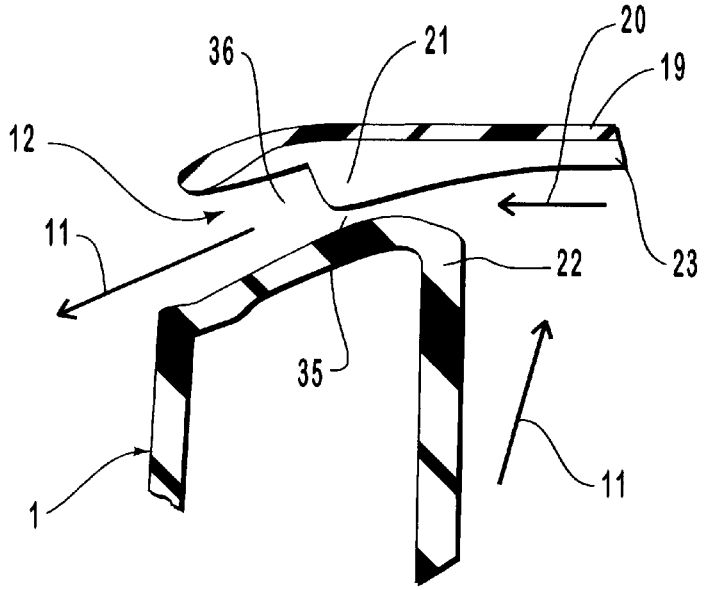
FIG. 2*b* shows a detailed representation of the part of FIG. 2*a* indicated by circle 2*b*.

FIG. 2*b* shows a detailed representation of the part of FIG. 2*a* indicated by circle 2*b*. Muffling of the air noise is achieved by wedge-shaped opening area 20 formed by top edge 22 of the rotor chamber wall 9 and the flow cutoff lower edge 21 formed as part of molded article 23 that is secured to the inside surface of the casing cover 19. As depicted in FIG. 2*b*, air exit opening 12 includes wedge-shaped opening area 20 which tapers to a transition gap 35. An enlarged mouth 36 extends from transition gap 35 to the exterior. The flow arrows 11 depict the air flow. When viewed in profile, the flow cutoff lower edge 21 and the opposite top edge 22 of the rotor chamber wall 9 form a wedge-shaped narrowing in the direction of the air flow.

Figure 2C:
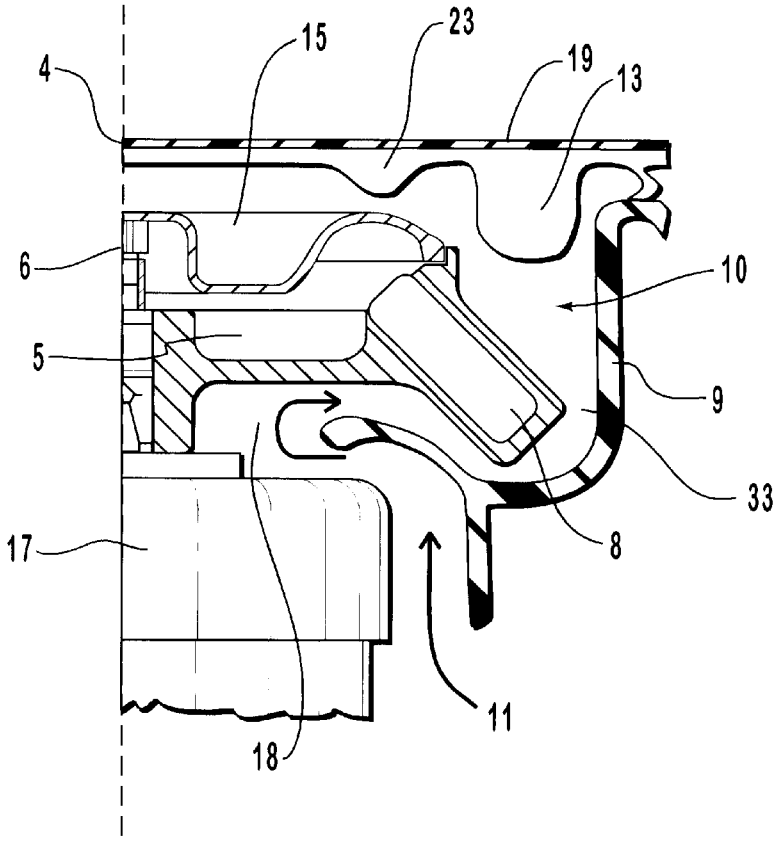
FIG. 2*c* shows a longitudinal section along the line 2*c*—2*c* through the rotor axis of FIG. 1 except that the rotor covering is shown in position over the rotor and the casing cover is shown closed upon the housing.

FIG. 2*c* shows a longitudinal section along the line 2*c*—2*c* through the rotor axis of FIG. 1 except that the rotor covering 15 is shown in position over the rotor and the casing cover 19 is shown in the closed position. FIG. 2*c* shows a cross-section through displacement body 13 which acts to prevent the turbulence which would otherwise arise due to negative pressure in the annular gap 10 between the rotor 5 and the top of the rotor chamber wall 9. An elastomer material, preferably rubber, is useful as the material for the displacement body 13 formed integrally with molded article 23. Other less elastic materials could also be used, if desired.

During centrifuge operation, an air flow represented by the arrows 11, rises in the lower area of housing 1 through air entry opening 16 in the underside of the housing (shown in FIG. 2*a*). The air flow is guided along the outside jacket of the drive motor 17 and into the lower annular gap-like opening 18 of the rotor chamber 33 which area includes the coupling area between the rotor 5 and the motor 17. A reversing profile 26 of the rotor chamber wall 9 is provided preferably between the drive motor 17 and the rotor 5 in this coupling area. The air flow is guided by the reversing profile 26 into the annular-shaped inside area of the rotor chamber 33 essentially along the direction of rotor axis 4 such that the cooling air flows around rotor 5. As a result of friction and centrifugal force, the surface structure of the rotor 5 pushes away the air surrounding it and, in accordance with the principle of the pressure-producing radial machine, into the peripheral upper area of the rotor chamber 33 and under the lower edge of the molded article 23 secured inside casing cover 19. The pressure causes the air to flow in a tangential direction into wedge-shaped opening area 20 (shown in FIGS. 2*a* and 2*b*) preferably formed in the area 29 of the casing cover 19 between hinges 2 and 3 and through the slit-like air exit opening 12. The air exiting through air exit opening 12 is preferably directed downward by flow cutoff lower edge 21.

The displacement body 13 reduces the turbulence which arises so that the air flow noises are minimized. The wedge-shaped opening area 20 having the narrowing profile and flow cutoff lower edge 21 reduce the flow noises which arise and also reduce the transmission of rotor operating noise to the outside. The production of rotor operating noise depends on the speed of the motor which preferably has an upper limit of about 13,000 rpm.

Figure 3:
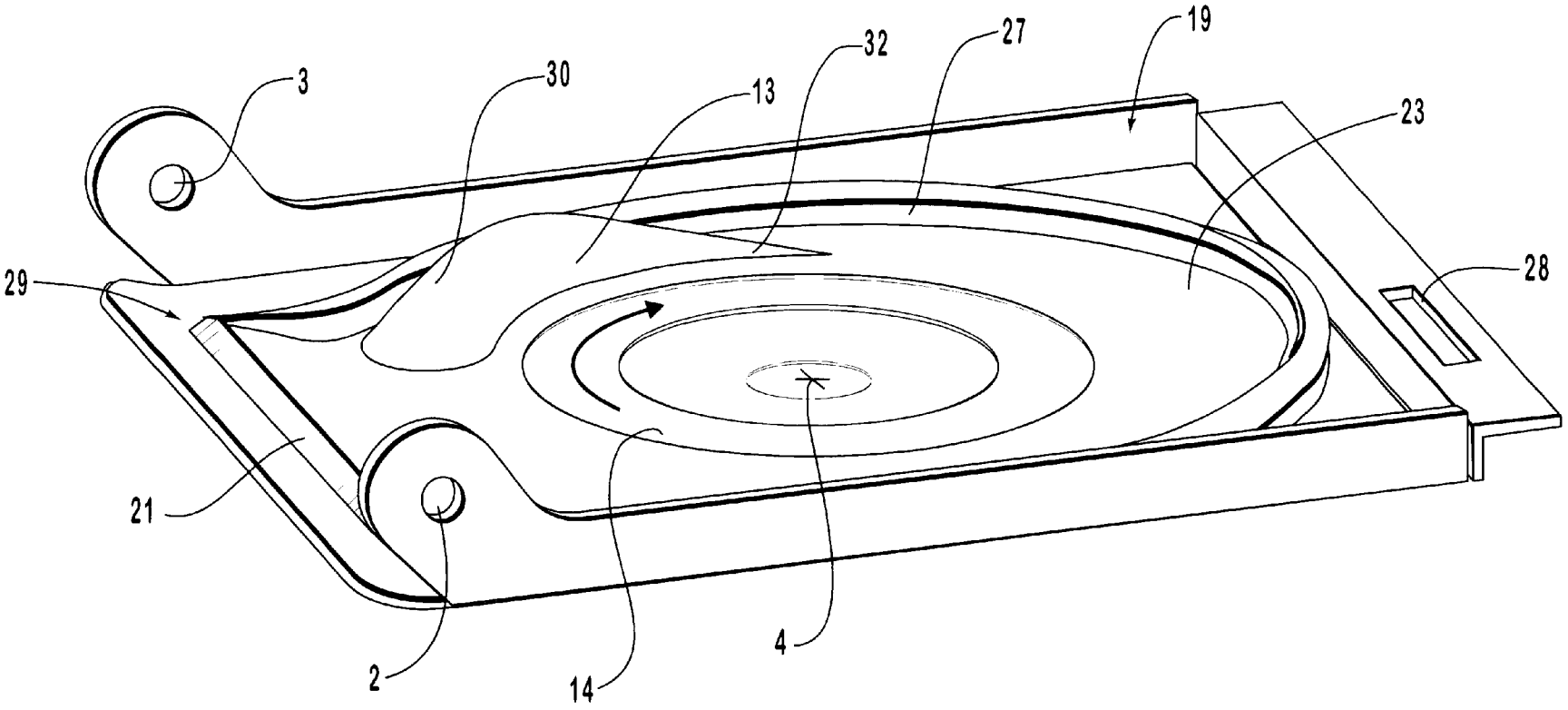
FIG. 3 schematically shows the inside of a casing cover in accordance with the present invention having the molded article inserted.

FIG. 3 shows a perspective representation of the casing cover 19 viewed from inside. The molded article 23 comprises seal 27 running around the perimeter and the displacement body 13 which projects into the annular gap 10 when the casing cover is closed. Displacement body 13 is positioned at the side of the area of the air exit opening 12 having the flow cutoff lower edge 21 such that the displacement body 13 directly follows the area of the air exit opening 12 when viewed in the direction of arrow 14 depicting the direction of rotation of the rotor 5. It is seen that displacement body 13 is aerodynamically shaped to have low air resistance. In particular, viewed from the direction of arrow 14, displacement body 13 has a rounded front 30 in accordance with the principle of flow on the bearing surface profile for airplanes and runs to a point 32 on its end area. The displacement body 13 must be sized and shaped to ensure an adequate safety distance between the rotor and displacement body when the casing cover 19 is closed. The position of the rotor axis 4 is depicted for reference purposes in the center of the molded article 23. The molded article 23 comprises the integral seal 27, flow cutoff lower edge 21, and displacement body 13.

The molded article is securely attached to the inside surface of the casing cover for example with two-sided tape, glue, or by vulcanizing. The hinges 2 and 3 are provided to mount the casing cover upon the housing at the hinge positions 2' and 3' shown in FIG. 1 to thereby permit the casing cover to be closed in a hinged manner. A locking part 28 to lock the casing cover in the closed position is typically also provided.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A laboratory centrifuge comprising:

(a) a housing containing a motor driving a rotor, the rotor being disposed within a rotor chamber within the housing, the housing having an access opening permitting access to the rotor and also having a air entry opening, the air entry opening being formed on the housing such that cooling air flows from outside the housing through the air entry opening and to the rotor in the rotor chamber during operation of the rotor;

(b) a casing cover movably mounted to the housing so as to selectively cover the access opening; and (c) an air exit opening extending from the rotor chamber to outside the housing, the air exit opening including a wedge-shaped portion with a cross section that narrows from the rotor chamber towards outside the housing, the air exit opening being configured such that the cooling air entering the rotor chamber exits through the air exit opening during operation of the rotor, the air exit opening being formed between the housing and the casing cover when the casing cover is covering the access opening.

2. A laboratory centrifuge as recited in claim 1, wherein the air exit opening has an elongated slit-like configuration.

3. A laboratory centrifuge as recited in claim 1, wherein the air exit opening includes a transition gap, the wedged-shaped portion projecting from the transition gap to the rotor chamber, and an enlarged mouth extending from the transition gap to outside the housing.

4. A laboratory centrifuge as recited in claim 3, wherein the enlarged mouth slopes downward.

5. A laboratory centrifuge comprising:

(a) a housing containing a motor driving a rotor, the rotor being disposed within a rotor chamber within the housing, the housing having an access opening permitting access to the rotor and also having a air entry opening, the air entry opening being formed on the housing such that cooling air flows from outside the housing through the air entry opening and to the rotor in the rotor chamber during operation of the rotor; and (b) a casing cover movably mounted to the housing so as to selectively cover the access opening, the casing cover and the housing forming an air exit opening therebetween when the casing cover is covering the access opening, the air exit opening having an elongated slit-like configuration and includes a wedge-shaped portion with a cross section that narrows from the rotor chamber towards outside the housing, the air exit opening being positioned such that the cooling air entering the rotor chamber exits through the air exit opening during operation of the rotor.

6. A laboratory centrifuge as recited in claim 5, wherein the casing cover is attached to the housing by a pair of spaced apart hinges, the air exit opening being formed between the spaced apart hinges.

7. A laboratory centrifuge as recited in claim 5, further comprising an air tight seal formed between the casing cover and the housing except at the air exit opening.

8. A laboratory centrifuge as recited in claim 5, wherein the air exit opening includes a transition gap, the wedged-shaped portion projecting from the transition gap to the rotor chamber, and an enlarged mouth extending from the transition gap to outside the housing.

9. A laboratory centrifuge as recited in claim 8, wherein the enlarged mouth is bounded by a flow cutoff lower edge that directs the exiting cooling air downward.

10. A laboratory centrifuge as recited in claim 6, wherein the rotor is configured to hold test tubes.

11. A laboratory centrifuge comprising:

(a) a housing containing a motor driving a rotor, the rotor being disposed within a rotor chamber within the housing, the housing having an access opening permitting access to the rotor and also having a air entry opening, the air entry opening being formed on the housing such that cooling air flows from outside the housing through the air entry opening and to the rotor in the rotor chamber during operation of the rotor;

(b) a casing cover movably mounted to the housing so as to selectively cover the access opening;

(c) an air exit opening extending from the rotor chamber to outside the housing, the air exit opening being configured such that the cooling air entering the rotor chamber exits through the air exit opening during operation of the rotor; and (d) a displacement body projecting from the casing cover into the rotor chamber, the displacement body being disposed at one side of the air exit opening so as to direct air out through the air exit opening during operation of the rotor, the displacement body having an aerodynamic rounded front end that tapers down to a point at the opposing end.

12. A laboratory centrifuge as recited in claim 11, wherein said displacement body is positioned to project at the side of the air exit opening so as to directly follow the air exit opening when viewed in the direction of rotation of the rotor.

13. A laboratory centrifuge as recited in claim 11, wherein said displacement body is molded from an elastomeric material and secured to the casing cover.

14. A laboratory centrifuge as recited in claim 11, wherein the displacement body is curved along a longitudinal axis thereof.

15. A laboratory centrifuge as recited in claim 11, wherein said air exit opening has a cross section narrowing in the direction of air flow.

16. A laboratory centrifuge comprising:

(a) a housing containing a motor driving a rotor, the rotor being disposed within a rotor chamber within the housing, the housing having an access opening permitting access to the rotor and also having a air entry opening, the air entry opening being formed on the housing such that cooling air flows from outside the housing through the air entry opening and to the rotor in the rotor chamber during operation of the rotor;

(b) a casing cover movably mounted to the housing so as to selectively cover the access opening; and (c) an air exit opening extending from the rotor chamber to outside the housing, the air exit opening including a wedge-shaped portion with a cross section that narrows from the rotor chamber towards outside the housing, the air exit opening being configured such that the cooling air entering the rotor chamber exits through the air exit opening during operation of the rotor, the air exit opening including a transition gap, the wedged-shaped portion projecting from the transition gap to the rotor chamber, and an enlarged downwardly sloping mouth extending from the transition gap to outside the housing.

* * * * *